US005336150A

United States Patent [19]

Mueller et al.

[11] Patent Number: 5,336,150

[45] Date of Patent: Aug. 9, 1994

[54] LEVER RESISTANCE SELECTION MECHANISM FOR STRENGTH TRAINING

[76] Inventors: King L. Mueller, 143 Hillcrest Dr., North Platte, Nebr. 69101; Reno A. Mueller, R.R. 2 Box 168, Moravia, Iowa 52571

[21] Appl. No.: 110,184

[22] Filed: Aug. 20, 1993

[51] Int. Cl.[5] ..... A63B 21/00

[52] U.S. Cl. ..... 482/112; 482/97; 482/102; 482/137

[58] Field of Search ..... 482/92, 97, 98, 99, 482/102, 103, 111, 112, 113, 133–138

[56] References Cited

U.S. PATENT DOCUMENTS

| | | | |
|---|---|---|---|
| 3,976,057 | 8/1976 | Barclay | 482/113 X |
| 4,426,077 | 1/1984 | Becker | 482/102 X |
| 4,431,184 | 2/1984 | Lew et al. | 482/102 X |
| 4,549,733 | 10/1985 | Salyer | 482/103 |
| 4,890,830 | 1/1990 | Kern | 482/102 X |
| 4,898,381 | 2/1990 | Gordon | 482/103 |
| 5,147,263 | 9/1992 | Mueller | 482/112 |

FOREIGN PATENT DOCUMENTS

| | | | |
|---|---|---|---|
| 9115270 | 10/1991 | PCT Int'l Appl. | 482/102 |

*Primary Examiner*—Robert Bahr

[57] ABSTRACT

A pneumatic strength training device that utilizes a sealed vacuum cylinder with an air pressure powered piston. The vacuum is obtained by removing the air from said cylinder and sealing said cylinder. The cylinder is then attached to a lever style lifting bar through a series of pulleys. The resistance encountered by the lifter is varied by positioning the pulleys at different locations on the lifting bar.

2 Claims, 4 Drawing Sheets

LEVER RESISTANCE SELECTION MECHANISM FOR STRENGTH TRAINING

BACKGROUND-FIELD OF THE INVENTION

This invention relates to exercise equipment used for increasing the strength of the human body.

BACKGROUND-DESCRIPTION OF PRIOR ART

Heretofore, pneumatic exercise equipment for strength training adjusted the amount of resistance the user received by regulating the air pressure within a pneumatic cylinder.

This pressure regulation is achieved by controlling the admission of air to the cylinder from a remote combination air tank/compressor unit or an electric pump mounted on the individual exercise machine (see U.S. Pat. Nos., 4,848,738, 5,147,263, 4,257,593, and 4,227,689).

These regulation methods expose the lifter to high pressure air lines or electrical cords. In addition, the remote air supply system has been reported by strength training athletes to feel more like a tire pump than a weight lifting machine.

Although this type of machine does give a continuous range of weight selections, they are more complex, cumbersome, and expensive. They are further limited in that they can only be placed in those areas that have access to electrical power or high pressure air lines.

It is known that as a gas is compressed, the resistance it exerts increases proportionately. On a strength training machine this resistance must be regulated in some manner to insure that it is usable for the human operator, adding to the machines complexity. The gas must be bled off and re-added per stroke, or a mechanical linkage must be incorporated to overcome the increased resistance of the compressing gas.

OBJECTS AND ADVANTAGES

Accordingly, several objects and advantages of this invention are:

A) to provide a pneumatic cylinder that does not require a pressure regulation device, eliminating the need for high pressure air lines or electrical power cords;

B) to provide a cylinder which gives equal resistance regardless of the position of the working piston;

C) to provide a pneumatic cylinder which eliminates the need for exposing the user to high pressure air lines or electrical cords, and potential physical injury;

D) to provide the user with continuous range of weight selections, without the use of complex, cumbersome, or expensive mechanisms;

E) to provide for the human user a machine that can be used anywhere, regardless of the accessibility of electrical power or high pressure air lines;

F) to provide for the user a machine that eliminates the tire pump feel of pressurized cylinder-based strength training machines, by substituting a vacuum cylinder instead of a pressurized cylinder.

BRIEF DESCRIPTION OF THE DRAWINGS

Some of the objects of the invention having been stated, other objects will appear as the description proceeds, when taken in connection with the accompanying drawings, in which.

DESCRIPTION OF THE PREFERRED EMBODIMENT

While the present invention will be described hereinafter with particular reference to the accompanying drawings, in which an operating embodiment of the apparatus of the present invention is shown, it is to be understood at the outset of the description which follows that it is contemplated that apparatus and methods in accordance with the present invention may be varied from the specific form described hereinafter while still retaining the desired result of this invention. Accordingly, the description which follows is to be understood as a broad teaching disclosure directed to persons of appropriate skill in the appropriate art, and not as limiting upon the scope of this invention.

Figure 2:
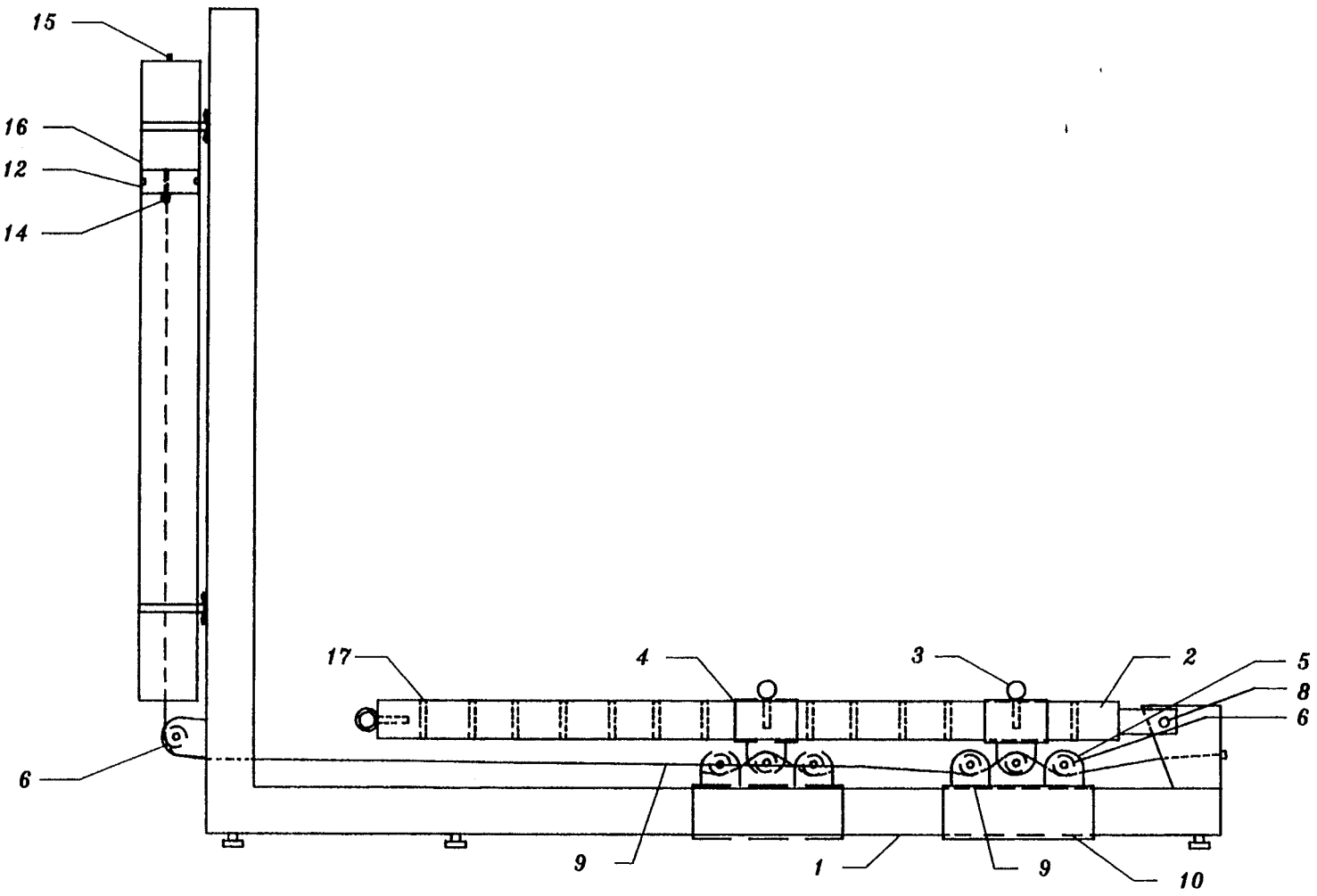
FIG. 2 is a cross-section of the invention.

Referring now to FIG. 2, the vacuum powered pneumatic strength training device consists of a frame 1 with an attached vacuum cylinder 16, having an operable piston 12 mounted therein for vertical sliding movement. An eyebolt 14 is fastened through the center of the piston 12 with a nut 11, to which a cable 9 is attached which extends through an opening at the end of the cylinder 16. After leaving the cylinder 16, the cable travels over a pulley 6 attached to the frame 1, travelling through the center of the upper frame 1 rail, emerging on the opposite side and running along the length of the lower frame 1 rail until it extends around the first pulley 6 of the lower double pulley adjustment slider 10, then over and around pulley 6 of the single pulley adjustment slider 4, traveling down and around the second pulley 6 of the double pulley adjustment slider 10, running the remaining length of the lower frame 1 rail and attaching at the end of said lower frame 1 rail.

Figure 1:
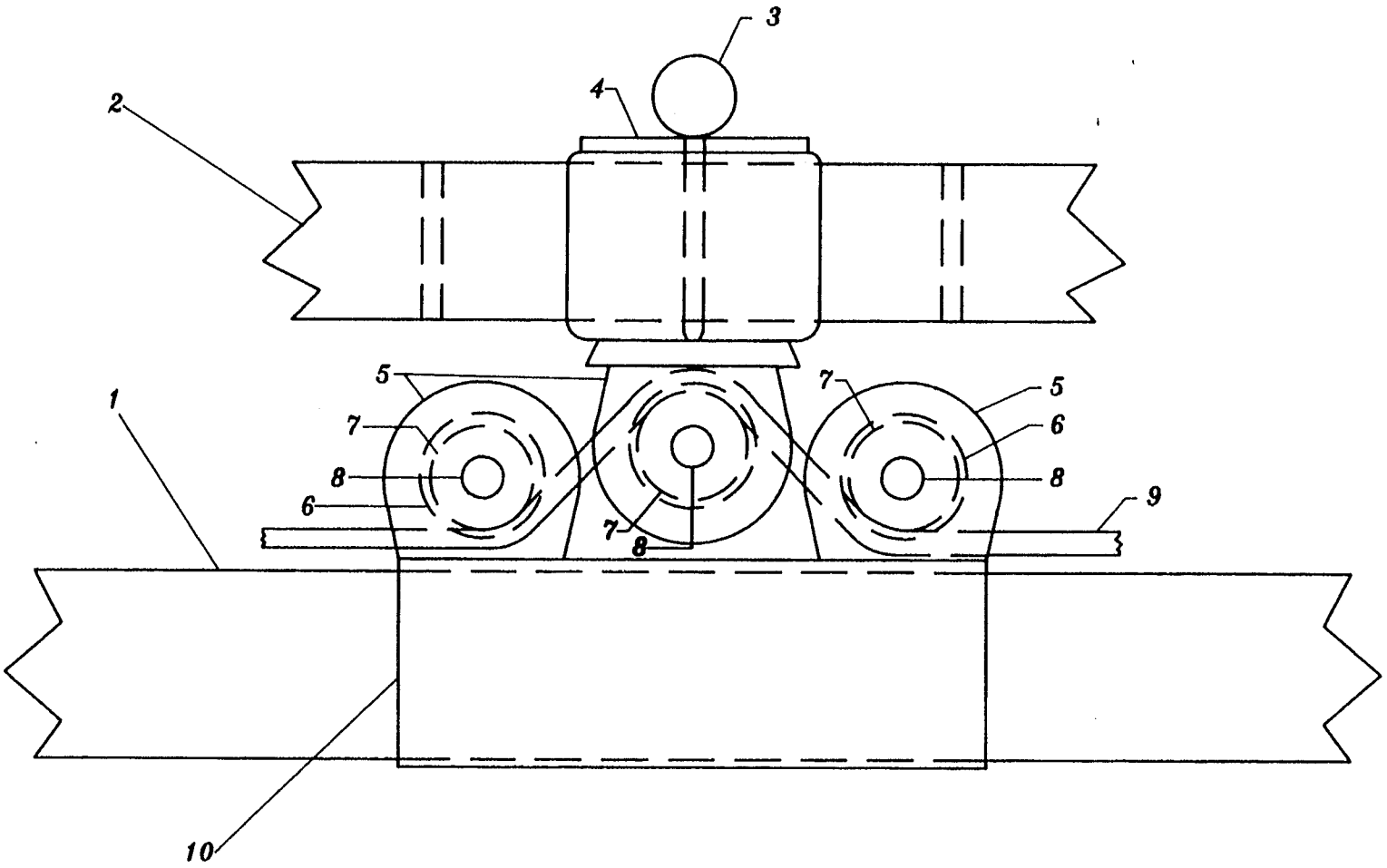
FIG. 1 is an enlarged cross-section of the resistance selection mechanism.

Referring now to FIG. 1, which is an enlarged view of the double pulley adjustment slider 10 and the single pulley adjustment slider 4. Both adjustment sliders are connected by means of the cable 9. The single pulley adjustment slider 4 is mounted on the lifting bar 2 so as to allow slideable movement along the length of the lifting bar 2. The single pulley adjustment slider 4 is held in place by the pin knob 3 at any point along the lifting bar 2 selected by the lifter, by inserting the pin knob 3 through the single pulley adjustment slider 4, and into any drilled hole 17 along the lifting bar 2. Adjustment of the single pulley adjustment slider 4 automatically drags the lower double pulley adjustment slider 10 into the proper position below the single pulley adjustment slider 4. The cable 9 then mechanically binds the double pulley adjustment slider 10 into a stationary position as the lifting bar 2 is raised and lowered by the lifter. The cable 9 rides within the pulley grooves 7 around the pulleys 6 which are mounted to the adjustment sliders 4 and 10 by mounting shafts 8. The cable 9 becomes a means of connecting the lifting bar 2 to the frame 1. As illustrated in FIG. 2, said lifting bar is also attached to the frame by a mounting shaft 8, which becomes a fulcrum for the frame 1 and lifting bar 2.

Figure 3:
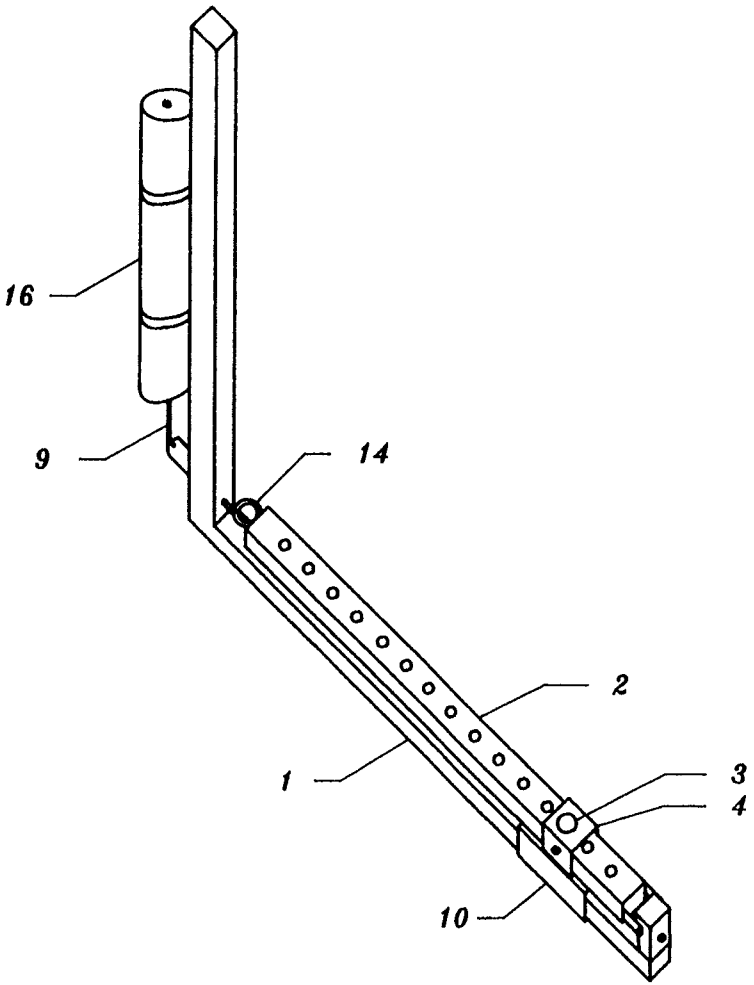
FIG. 3 is an overhead view of the resistance selection holes.

As shown in FIG. 3, the pin knob 3 positioning holes are linearly situated the entire length of the lifting bar 2.

Figure 4:
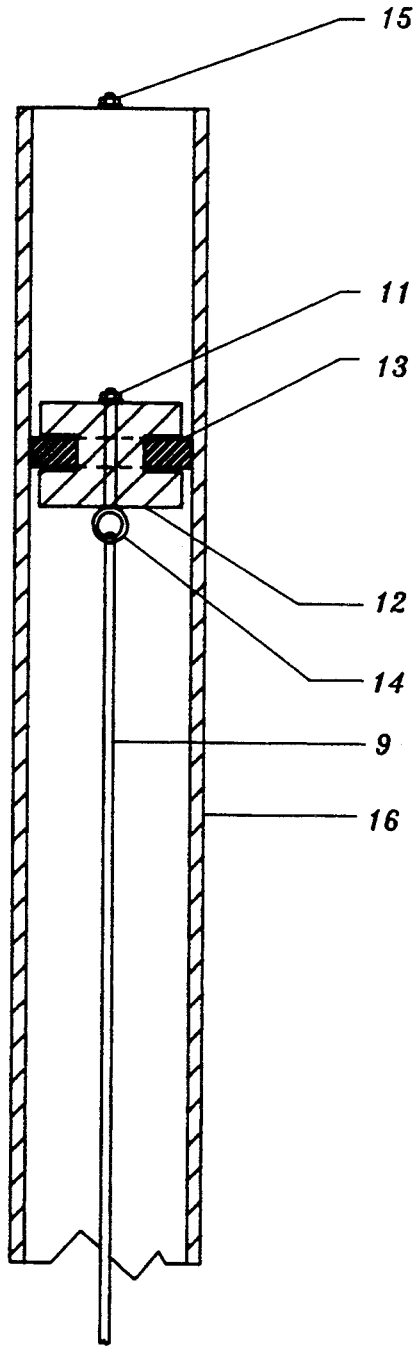
FIG. 4 is a cross-sectional view of the vacuum cylinder.

Referring now to FIG. 4 a cross-sectional view of the vacuum cylinder 16. The vacuum cylinder 16 is sealed on one end, with a piston 12 mounted within. The space between the piston 12 and the sealed end of the cylinder is a vacuum. The air in the space is removed by pushing the piston 12 to the sealed end of the cylinder 16 with the vacuum release bolt opened. After the piston 12 is pushed to the end of the cylinder 16, the vacuum release bolt 15 is tightened, sealing the cylinder and effectively creating a vacuum whenever the piston 12 is pulled downward by the cable 9, which is attached to the piston 12 by the eye bolt 14 and nut 11. The piston does have slideable movement when drawn down by the cable, with the vacuum being maintained by, a resilient seal 13 which is mounted between the piston 12 and cylinder 16. Once the piston 12 is pulled downward by the cable 9, the external air pressure exerts a force on the side of the piston 12 facing the open end of the cylinder ,16. The vacuum pressure will remain constant regardless of the location of the piston 12 within the cylinder 16.

Referring now to FIG. 2 the machine is activated by a person exercising who applies force to the eye bolt 14 located at the end of the lifting bar 2, using said force to increase the distance between the lifting bar 2 and the frame 1. This puts tension on the cable 9 drawing the piston downward. The person exercising continues to lift until the exercise is completed, returning the lifting bar 2 to its normal resting position. Prior to applying force to the lifting bar 2 the person exercising selects the desired amount of resistance by moving the adjustment sliders 4 and 10 into appropriate corresponding position. The closer the adjustment sliders are to the fulcrum the less resistance the person exercising will encounter. Conversely, then the greater the distance of the adjustment sliders 4 and 10 from the fulcrum the greater the resistance encountered by the person exercising.

We claim:

1. An exercise apparatus comprising:

a frame;

a lifting bar having a proximal end and a distal end, the proximal end pivotally mounted to the frame, the frame having a first portion extending parallel with and adjacent to the lifting bar when the lifting bar is in a rest position;

a first adjustment slider having a single pulley thereon, the first adjustment slider slidably mounted on the lifting bar for sliding movement therealong;

a first locking means for locking the first adjustment slider at a selected position along the lifting bar;

a second adjustment slider having a pair of pulleys thereon, the second adjustment slider slidably mounted on the first frame portion for sliding movement therealong, and the pair of pulleys spaced apart a sufficient distance so as to accommodate the single pulley of the first adjustment slider therebetween;

a second locking means for locking the second adjustment slider at a selected position along the first frame portion;

a resistance mechanism mounted on the frame; and, a cable connected at one end to the resistance mechanism, passing over one of the pair of pulleys of the second adjustment slider, then passing over the single pulley of the first adjustment slider, then passing over the other of the pair of pulleys of the second adjustment slider, then connected at the other end to the frame, where the user may selectively lock the first adjustment slider to the lifting bar and lock the second adjustment slider to the first frame portion at a position such that the single pulley of the first adjustment slider is located between the pair of pulleys of the second adjustment slider when the lifting bar is in a rest position, and where the position of the first adjustment slider along the lifting bar determines the effective resistance of the resistance mechanism.

2. The exercise apparatus of claim 1, wherein the resistance mechanism comprises a hollow upright cylinder mounted on the frame, the cylinder having an internal wall, and upper and lower ends, the lower end being sealed and the upper end having an opening therein through which the cable extends, a piston operably mounted for reciprocal movement within the cylinder, the piston having a seal of resilient material forming a seal between the piston and the internal wall of the cylinder, the cable connected to the piston such that movement of the piston in response to pivotal movement of the lifting bar results in a partial vacuum between the piston and the lower end of the cylinder, which partial vacuum provides resistance to the pivotal movement of the lifting bar.

* * * * *